US005517705A

United States Patent [19]

Jackson

[11] Patent Number: 5,517,705

[45] Date of Patent: May 21, 1996

[54] BACK SCRUBBING DEVICE

[76] Inventor: Horace L. Jackson, 200 Ward La., Williamstown, N.J. 08094

[21] Appl. No.: 427,211

[22] Filed: Apr. 24, 1995

[51] Int. Cl.[6] ..... A47K 7/02

[52] U.S. Cl. ..... 4/606; 15/104.92; 15/160; 15/244.1; 401/42; 401/289; 601/155

[58] Field of Search ..... 4/605, 606; 15/104.92, 15/160, 244.1; 401/42, 289; 601/155

[56] References Cited

U.S. PATENT DOCUMENTS

| | | | |
|---|---|---|---|
| 3,042,949 | 7/1962 | Mosely | 4/606 |
| 3,085,269 | 4/1963 | Greer | 15/21.1 |
| 3,196,867 | 7/1965 | Perry | 4/606 |
| 3,209,372 | 10/1965 | Boyett, Sr. et al. | 4/606 |
| 3,478,369 | 11/1969 | Ensley | 4/606 |
| 4,020,519 | 5/1977 | Robison | 15/104.92 |
| 4,053,960 | 10/1977 | Kingswell | 15/104.92 |
| 4,417,362 | 11/1983 | Walker | 4/606 |
| 4,696,068 | 9/1987 | Kenner | 4/606 |
| 4,704,756 | 11/1987 | Williams et al. | 15/21.1 |
| 5,239,712 | 8/1993 | Kinder | 4/606 |
| 5,345,640 | 9/1994 | Goss | 4/606 |

FOREIGN PATENT DOCUMENTS

| | | | |
|---|---|---|---|
| 2347001 | 11/1977 | France | 4/606 |
| 2426432 | 12/1975 | Germany | 4/606 |
| 2613947 | 10/1977 | Germany | 15/160 |

*Primary Examiner*—Mark Spisich

*Attorney, Agent, or Firm*—Norman E. Lehrer; Jeffrey S. Ginsberg

[57] ABSTRACT

A back scrubbing device is adapted to be secured to a shower wall. The device includes a main housing that has front and rear walls, opposing side walls and top and bottom walls. The front wall has a plurality of perforations formed therethrough and the top and bottom walls each have an opening formed therethrough. A water supply hose has one end connected to the opening in the bottom wall of the main housing and the opposing end is secured to a shower head or bathtub faucet for supplying water to the device. A brush is secured to the front wall of the main housing and has a plurality of apertures formed therethrough. The apertures in the brush are aligned with the perforations in the front wall of the main housing so that water can pass therethrough. A container for holding liquid soap is mounted in the main housing. The container includes a dispenser extending from the top wall of the housing for dispensing the liquid soap contained therein.

9 Claims, 3 Drawing Sheets

BACK SCRUBBING DEVICE

BACKGROUND OF THE INVENTION

The present invention is directed toward a back scrubbing device and, more particularly, to such a device that can be mounted to a shower wall.

Presently, there are a number of known devices that are adapted to be used to assist persons in washing their backs or other hard to reach areas of their body. For example, U.S. Pat. No. 4,704,756 discloses a water powered brush that is mounted to a shower wall. The device includes a relatively complex valve assembly that permits the downward flow of water from an opening in a housing onto one of several brushes. This back scrubber requires the user to independently apply soap to the brushes before use as it does not contain means for supporting a soap dispenser.

U.S. Pat. No. 3,085,269 discloses a shower brush that is rotated by the action of water that comes from a conventional discharge pipe. The shower brush includes a soap dispensing unit which is adapted to dispense a liquid soap solution through the brush member. This is a complicated device utilizing a number of moving parts.

Another soap dispensing back scrubber is disclosed in U.S. Pat. No. 4,417,362. This apparatus is not adapted to have water flow from an outlet onto a sponge, brush or the like. U.S. Pat. Nos. 4,020,519, 4,053,960 and 4,696,068 disclose similar devices.

SUMMARY OF THE INVENTION

The present invention is designed to overcome the deficiencies of the prior art discussed above. It is an object of this invention to provide a back scrubbing device that enables a bather to effectively clean difficult to reach areas.

It is a further object of the invention to provide such a such a device that is easy to manufacture and assemble.

It is yet another object of the invention to provide such a device that can readily be attached to an existing shower head or faucet.

In accordance with the illustrative embodiments, demonstrating features and advantages of the present invention, there is provided a back scrubbing device that is attachable to a shower wall. The device includes a main housing with encircling side walls and top and bottom walls. An opening is formed through the top and bottom walls. A container, that is adapted to hold a supply of liquid soap, is mounted in the main housing. Associated with the container and extending from the top wall of the housing is a pump type soap dispenser. A pair of brushes are secured to the front wall of the housing. A flexible hose has one end connected to a water supply source and an opposing end connected through the opening in the bottom wall of the main housing. The hose supplies water into the main housing and through at least one of the brushes. The back scrubbing device includes means for securing the same to a shower wall.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
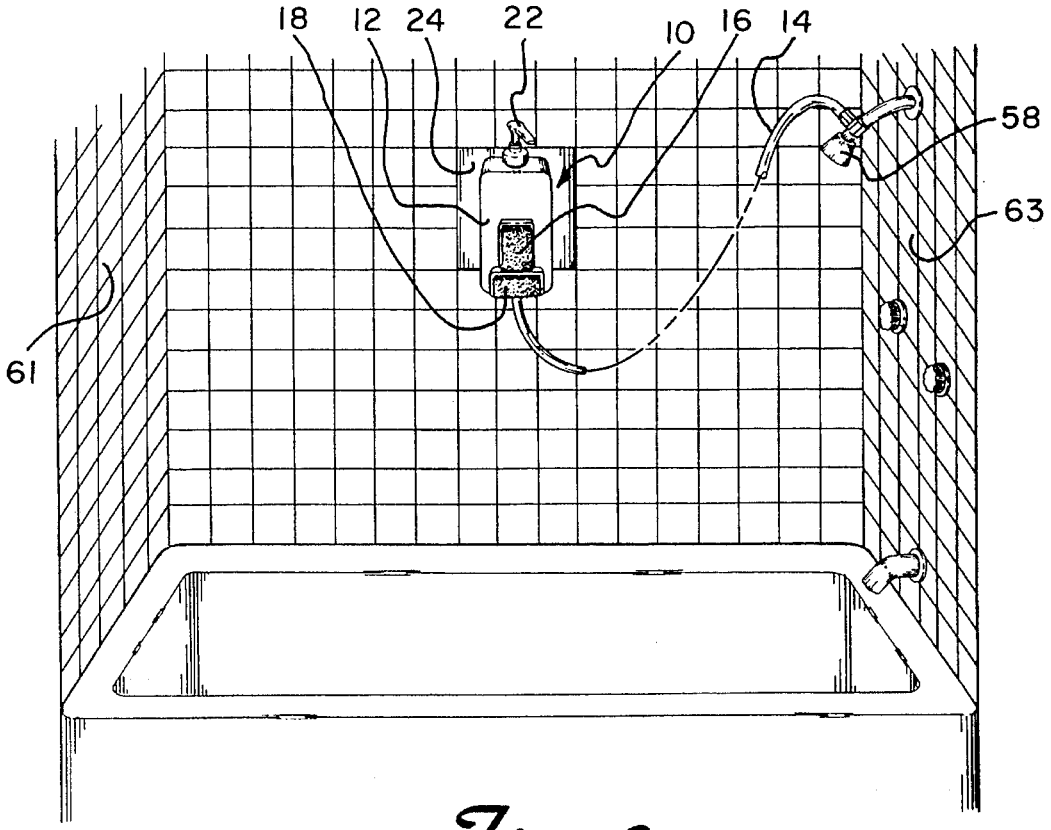
FIG. 1 is a perspective view of the back scrubbing device shown permanently secured to a shower wall.

Referring now to the drawings in detail wherein like reference numerals have been used throughout the various figures to designate like elements, there is shown in FIGS. 1, 3, 4 and 6 a back scrubbing device constructed in accordance with the principles of the present invention and designated generally as 10.

The back scrubbing device 10 includes a main housing 12, a water supply hose 14, a pair of brushes 16 and 18 secured to the housing, a liquid soap container 20 mounted in the housing 12 and a pump type dispenser 22 associated with the container 20 and extending from the top of main housing 12. In this embodiment, the device 10 is secured to and integral with an enlarged bathroom tile 24 which is secured to a shower wall 26 as more fully described below.

Figure 6:
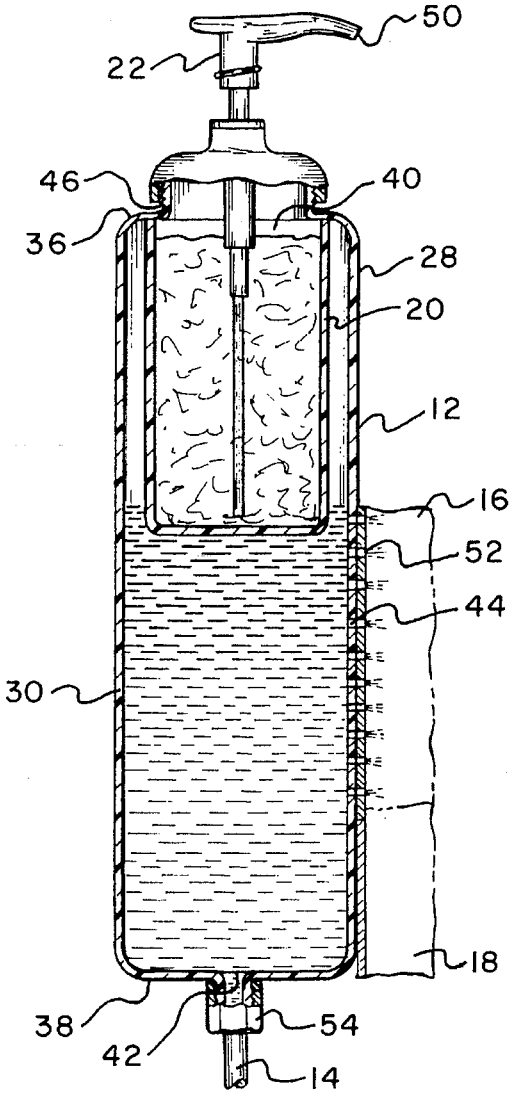
FIG. 6 is a side cross-sectional view of the back scrubbing device.
Figure 7:
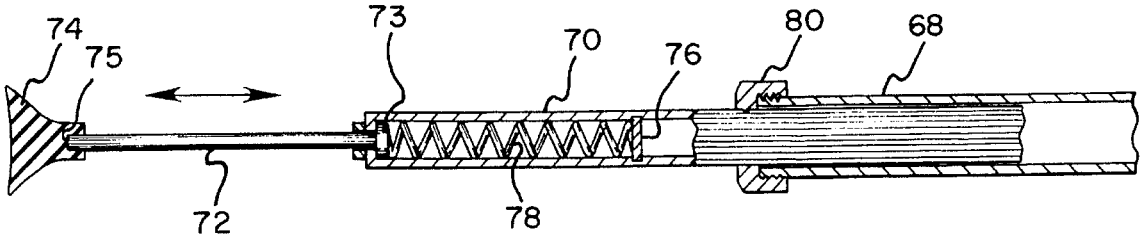
FIG. 7 is a cross-sectional view of one of the spring rods.

The main housing 12 includes front and rear walls 28 and 30, opposing side walls 32 and 34, and top and bottom walls 36 and 38. The walls define an open space therein. The top and bottom walls 36 and 38 each have an opening 40 and 42, respectively, formed therethrough as best shown in FIG. 6. A plurality of perforations 44 are formed through the front wall 28. The main housing 12 is preferably made of a thermoplastic material such as polypropylene. However, the main housing can be comprised a variety of other materials.

In the preferred embodiment, a threaded extension 46 projects upwardly from the periphery of the opening 40 in the top wall 36 of the main housing 12. Extending downwardly from the top wall 36 and into the open space of the housing is the liquid soap or inner container 20. The inner container has four encircling side walls, an open top end and a bottom. The open top end is at least partially aligned with the opening 40 in the top wall 36. The uppermost portion of the side walls of the inner container are integral with the top wall 36 of the main housing 12. The inner container is also preferably made of polypropylene and is of a substantially smaller size than the main housing. Liquid soap is introduced through the opening 40 in the top wall of the main housing and into the inner container 20. Alternatively, it is contemplated that the main housing 12 can be so constructed to have a cavity or recess formed in the top thereof. In such an embodiment, a conventional liquid soap dispenser can be positioned in the recess and can readily be removed therefrom when the supply of liquid soap contained therein has be expended.

The pump type dispenser 22, which is well known in the art, is threadably secured around the external threads on the extension 46. Upon manipulation of the dispenser, liquid soap contained in the inner container 20 exits the dispenser through outlet port 50 and is directed onto the brush 16.

The brushes 16 and 18 are secured to the front wall 28 of the main housing 12. In the preferred embodiment, the brush 18 is secured immediately adjacent to the bottom wall 38 of the main housing. Brush 16 is mounted atop brush 18 and has a plurality of apertures 52 formed therethrough. The apertures are aligned with the perforations 44 in the front wall 28 of the housing 12 so that water can pass through the main housing and out of the brush 16. It should be noted that the brushes 16 and 18 can be removably secured to the front wall so that they can be readily replaced. Additionally, instead of brushes, sponges or other similar scrubbing elements can be utilized. Furthermore, one brush or other scrubbing element can be utilized instead of two.

Connecting elements 54 and 56 are secured to opposite ends of the flexible hose 14. Connecting element 54 is adapted to be secured to the opening 42 in the bottom wall 38 of the main housing 12 while connecting element 56 is adapted to be secured to a shower head 58 as best illustrated in FIG. 1. The shower head 58 is preferably equipped with a T-valve to facilitate attachment of connecting element 56 thereto. When so attached the flexible hose 14 supplies water from the shower head to the main housing 12. It should be noted that the flexible hose 14 can be secured to a bathroom faucet or other water supply source rather than a shower head. Additionally, the hose can be mounted within the shower wall and secured to a water supply pipe located therein. Such a device would necessarily include a shut off valve located on the wall.

As stated above, the rear wall 30 of the main housing 12 is secured to an enlarged tile 24. The tile is preferably made of the same material of which conventional bathroom tiles are made, i.e. ceramic material. In order to secure the back scrubbing device 10 to a shower wall 26, existing bathroom tiles must be removed (see FIG. 4). The enlarged tile 24 is then glued or cemented directly to the shower wall. The tile 24 preferably has the same thickness as conventional bathroom tiles so that the tile 24 can be mounted flush with the other tiles. Of course, the back scrubbing device 10 could be mounted to a shower or bathtub stall in other ways.

Figure 2:
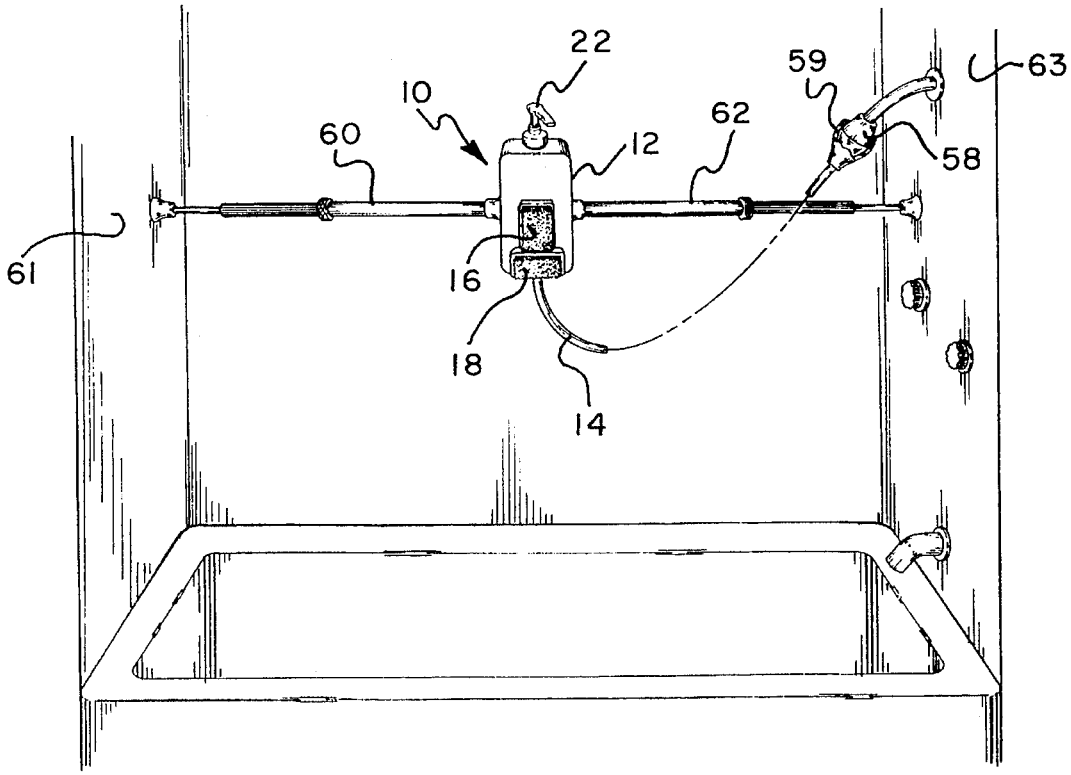
FIG. 2 is a perspective view of an alternate embodiment showing a back scrubbing device removably secured to a shower wall.
Figure 3:
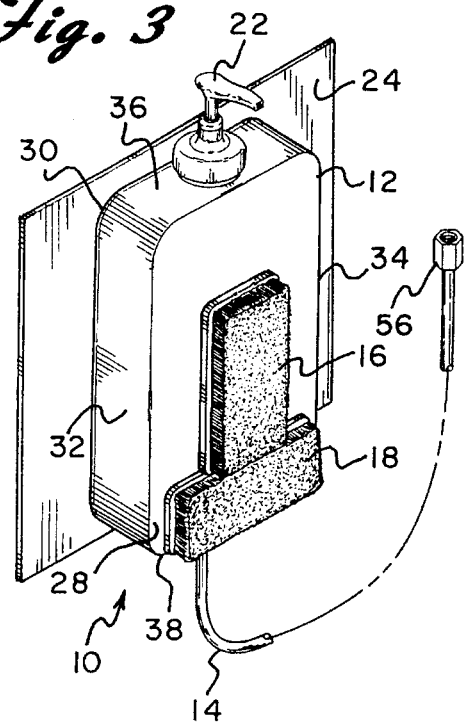
FIG. 3 is a perspective view of the embodiment shown in FIG. 1.
Figure 4:
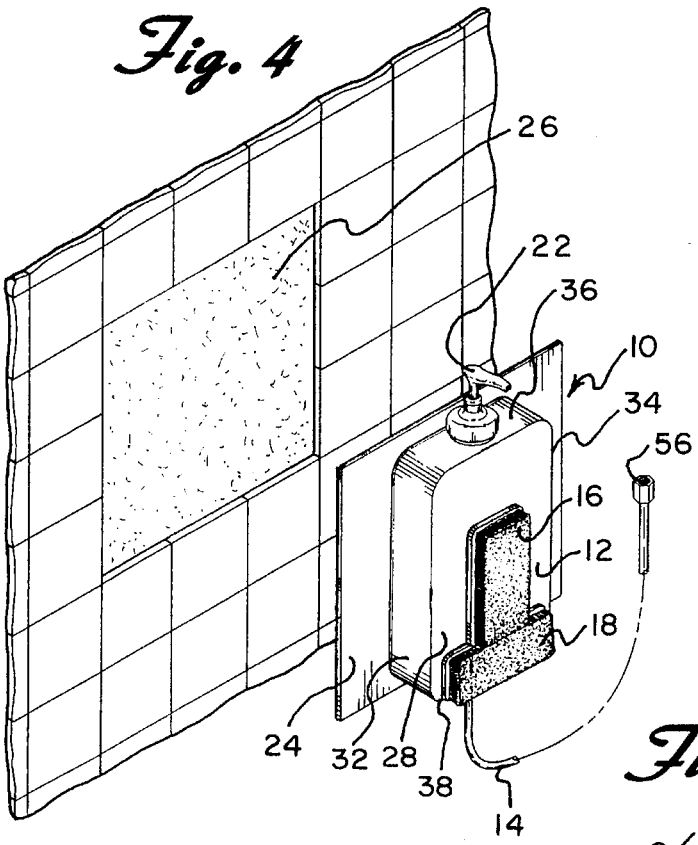
FIG. 4 is a view similar to FIG. 3 showing a shower wall adapted to receive the back scrubbing device.

For example, in a portable embodiment of the invention disclosed in FIG. 2 a back scrubbing device 10 is shown mounted to a pair of opposing shower walls 61 and 63. This embodiment is substantially the same as the back scrubbing device disclosed in FIGS. 1, 3 and 4 with a couple of exceptions. Firstly, the shower hose 14 has an elastic cup-shaped portion 59 at its distal end. This cup-shaped portion is sized to be removably secured over a shower head 58. Another difference is that an enlarged tile is not secured to the rear wall 30 of the main housing 12. Instead, spring rod assemblies 60, 62, 64 and 66 extend from the opposing side walls 32 and 34 of the main housing. It should be noted that spring rods can extend from the top and bottom walls 36 and 38 instead of the side walls. Each of the spring rod assemblies is substantially identical to the other. Accordingly, only one of the assemblies will be described in detail, it being understood that the description applies equally to the other assemblies.

Spring rod assembly 60 includes a main tubular component 68 that has one end secured to side wall 32 of the main housing 12. The end of the tubular component furthest from the side wall 32 has external threads formed thereon. Partially extending into the externally threaded end of the component 68 is a cylinder 70. A shaft 72 has an end 73 slidably mounted in the cylinder 70 and has a suction cup 74 secured to the opposing end 75. A disc-shaped stopper 76 is mounted in the cylinder 70. Positioned between the stopper 76 and the end 73 of the shaft 72 is a spring 78. When the shaft is manually manipulated to extend further into the cylinder 70, the spring acts to force the shaft back out of the same.

In this embodiment, a threaded connector 80 is secured to the external threads on the tubular component 68. The connector 80 has an opening formed therethrough. The diameter of the opening in the connector is substantially equivalent to the diameter of the cylinder 70. The connector frictionally engages the shaft 70 so that further entry into the tubular component 68 is impeded. When the connector 80 is unthreaded from the tubular component 68, the cylinder 70 can be moved further into the component 68. Accordingly, the length of the spring rod assembly can be increased or decreased to accommodate different spacings between the shower walls.

Figure 5:
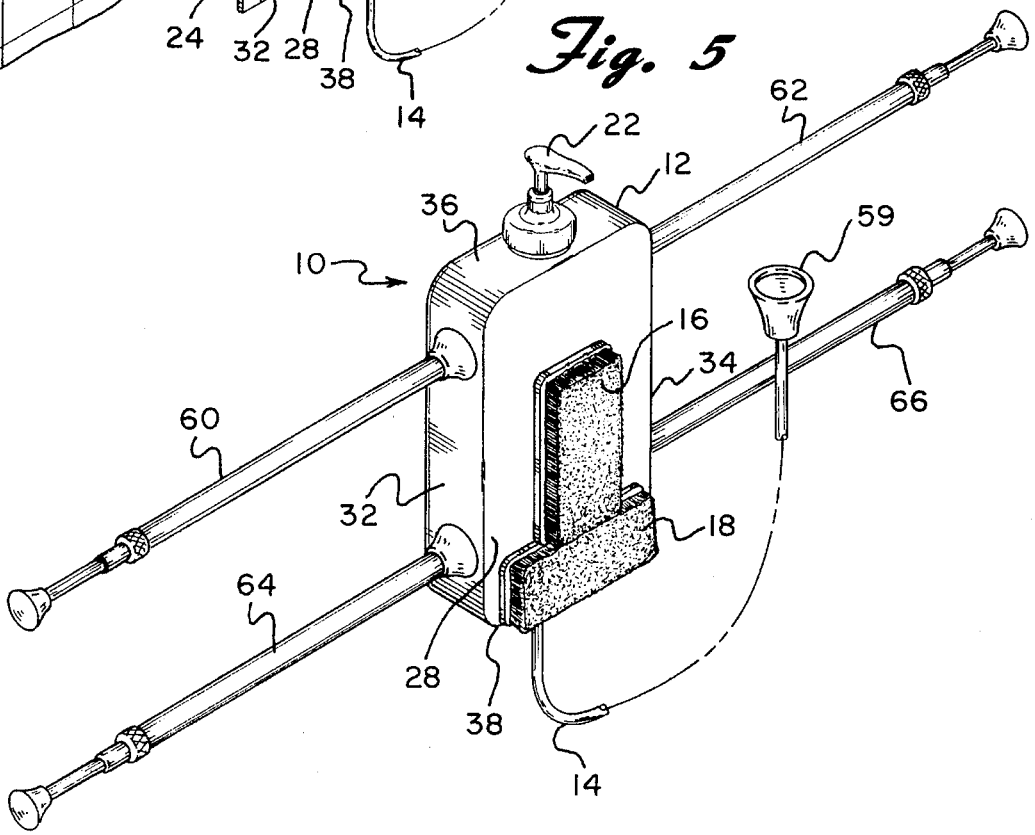
FIG. 5 is a perspective view of an embodiment similar to that shown in FIG. 2 but with two pairs of spring rods secured thereto.

In this embodiment, at least two spring rod assemblies must be utilized in order to secure the scrubbing device 10 between two shower walls as illustrated in FIG. 2. However, additional spring rod assemblies can be employed to further secure the device 10 between the shower walls (see FIG. 5).

To facilitate an understanding of the principles of the foregoing apparatus, its operation will now be briefly described. The back scrubbing device is first secured in place. In the embodiment disclosed in FIGS. 1, 3 and 4, the device 10 is permanently secured to a shower wall by cementing the enlarged tile 24 thereto. In the embodiment disclosed in FIG. 2, the device is secured between a pair of opposing shower walls by manually forcing shaft 72 of a spring rod assembly to move further into cylinder 70 against the restoring forces of spring 78. When the user releases pressure on the shaft, the spring forces the shaft toward a shower wall. Suction cup 74 engages the wall thereby securing the spring rod assembly in place. This is repeated for a spring rod assembly extending from an opposing side wall of the main housing 12.

Once the scrubbing device is secured in place, the flexible hose 14 is secured to a water supply source such as a shower head 58. This is accomplished by securing the hose to a T-valve extending from the shower head assembly 58 as illustrated in FIG. 1 or by inserting cup-shaped portion 59 over the shower head as shown in FIG. 2. Water traveling from the shower head flows through the flexible hose into the main housing 12 and out the perforations 44 formed in the front wall 28. Water then flows through the apertures 52 in the brush 16 to the bather.

When desired, the bather depresses the pump portion of the dispenser 22 so that liquid soap drops out of the same and onto the brushes 16 and 18. Accordingly, the bather can scrub his or her back by rubbing against the soap-covered brushes 16 and 18. As water continues to travel through the apertures 52 in the brush 16 the soap is eventually washed away.

The present invention may be embodied in other specific forms without departing from the spirit or essential attributes thereof and accordingly reference should be made to the appended claims rather than to the foregoing specification as indicating the scope of the invention.

What is claimed is:

1. A back scrubbing device for attachment to a shower wall comprising:

a main housing including a front and rear wall, a pair of opposing side walls and top and bottom walls, said top wall having an opening formed therein, said front wall having a plurality of perforations formed therethrough;

a container for holding a predetermined supply of liquid soap, said container being mounted in said main housing;

means for dispensing said liquid soap, said dispensing means extending from the top of said container and through said opening in said top wall of said main housing;

means for scrubbing secured at least partially over said perforations in said front wall of said main housing;

means for securing said back scrubbing device to a shower wall, and means for supplying water into the interior of said main housing and through said perforations in said front wall of the same.

2. The back scrubbing device of claim 1 wherein said water supplying means includes a flexible hose and a water outlet that has a valve extending therefrom, said flexible hose having one end secured to an opening in said bottom wall of said main housing and an opposing end secured to said valve extending from said water outlet.

3. The back scrubbing device of claim 1 wherein said scrubbing means includes a first brush and a second brush, said first brush being positioned above said second brush.

4. The back scrubbing device of claim 3 wherein said top brush includes a plurality of apertures formed therethrough, said apertures being aligned with said perforations in said front wall of said main housing for allowing water to pass therethrough.

5. The back scrubbing device of claim 1 wherein said securing means includes said rear wall of said main housing being secured to and integral with an enlarged shower wall tile, said tile being secured to said shower wall by gluing the same thereto.

6. The back scrubbing device of claim 1 wherein said securing means includes first and second spring rod means, said first spring rod means being secured to one of said side walls of said main housing and said second spring rod means being secured to the other side wall, each of said spring rod means being adapted to removably engage a corresponding shower wall.

7. The back scrubbing device of claim 6 wherein each of said spring rod means includes a tubular component extending from one of said side walls of said main housing, a hollow cylinder secured in said tubular member and a spring biased rod extending from said cylinder.

8. The back scrubbing device of claim 7 wherein each of said rods of said spring rod means includes a suction cup secured to one end thereof for releasably engaging a shower wall.

9. The back scrubbing device of claim 1 wherein said water supplying means includes a flexible hose and a water outlet, said flexible hose having one end secured to an opening in said bottom wall of said main housing and an opposing end having a cup-shaped portion secured thereto, said cup-shaped portion being adapted to frictionally engage said water outlet.

* * * * *